US006263716B1

(12) United States Patent
Kaplan

(10) Patent No.: US 6,263,716 B1
(45) **Date of Patent: *Jul. 24, 2001**

(54) HOT STRIP REVERSING MILL WITH A SHAPEMETERING APPARATUS

(75) Inventor: Naum M. Kaplan, Monroeville, PA (US)

(73) Assignee: Tippins Incorporated, Pittsburgh, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/180,002

(22) PCT Filed: Sep. 19, 1996

(86) PCT No.: PCT/US96/15476

§ 371 Date: Aug. 19, 1999

§ 102(e) Date: Aug. 19, 1999

(87) PCT Pub. No.: WO97/40951

PCT Pub. Date: Nov. 6, 1997

Related U.S. Application Data

(63) Continuation-in-part of application No. 08/639,724, filed on Apr. 29, 1996, now Pat. No. 5,901,591.

(51) Int. Cl.[7] ..... B21B 41/06

(52) U.S. Cl. ..... 72/229; 72/9.1; 72/11.7; 72/365.2

(58) Field of Search ..... 72/8.4, 9.1, 9.2, 72/11.7, 11.8, 229, 365.2

(56) References Cited

U.S. PATENT DOCUMENTS

| | | | | |
|---|---|---|---|---|
| 3,331,232 | * | 7/1967 | King | 72/229 |
| 4,262,511 | * | 4/1981 | Boisvert et al. | 72/9.1 |
| 4,580,428 | * | 4/1986 | Brettbacher et al. | 72/226 |
| 4,782,683 | * | 11/1988 | Tippins et al. | 72/229 |
| 5,010,756 | * | 4/1991 | Nose et al. | 72/9.1 |
| 5,285,684 | * | 2/1994 | Uesugi et al. | 73/159 |
| 5,901,591 | * | 5/1999 | Kaplan | 72/9.1 |

FOREIGN PATENT DOCUMENTS

| | | | | |
|---|---|---|---|---|
| 112781 A2 | * | 12/1983 | (EP) | 72/12.3 |
| 6-269855 | * | 12/1983 | (JP) | 72/148 |

* cited by examiner

*Primary Examiner*—Ed Tolan
(74) *Attorney, Agent, or Firm*—Webb Ziesenheim Logsdon Orkin & Hanson, P.C.

(57) ABSTRACT

A shape detection device is incorporated as part of a hot strip reversing mill. The shape detection device is a shape detector roll adapted to contact the metal strip. The shape detector roll is used to provide data to an automated shape control and steering system. Preferably, the hot strip reversing mill includes a pair of hot reversing stands and a pair of coiler furnaces positioned on opposite sides of the pair of mill stands.

19 Claims, 2 Drawing Sheets

HOT STRIP REVERSING MILL WITH A SHAPEMETERING APPARATUS

This is a continuation-in-part of U.S. patent application Ser. No. 08/639,724 filed on Apr. 29, 1996, now U.S. Pat. No. 5,901,591.

BACKGROUND

1. Field of Invention

The present invention relates to shape detection methods and apparatuses for a hot strip mill and, more particularly, to a shape detection device and method used in conjunction with a hot strip reversing mill.

2. Background Art

During the hot rolling of metal strip, such as steel, the rolling process can cause undesirable shape defects in the profile and flatness along the width of the metal strip. This generally results from internal stress differentials within the strip which appear during reduction in a hot strip reversing mill having coiler furnaces on opposite sides. As the need for improved shape is ever present from a mill, techniques are required to ensure the desired shape is achieved during the reduction of the metal strip.

These shape defects can be greatly minimized and often avoided by applying shape control techniques in controlling the rolls of the mill. Shape control techniques include adjustments at the reversing stand of roll bending, screw-down positions, roll shifting and roll cooling. Also, it is important to control the steering of the metal strip between the rolls at the reversing stand to keep the metal strip tracking on mill center.

In order to apply the shape control techniques, the operator must be able to detect when the process is causing the shape defects or when the metal strip tracks off mill center. Currently, the operator visually checks for defects caused by the process and ensures that the metal strip is tracking on mill center. The operator then must adjust the mill manually using the shape control techniques to correct for defects and adjust steering of the metal strip if the metal strip is off mill center.

Pressure transducers and load cells have been used on each side of the reversing stands to detect force differentials between the stand sides to indicate the metal strip is tracking off mill center. The use of pressure transducers or load cells can be unreliable because strip geometry, temperature changes in the metal or hardness of the metal can also cause force differentials that can be detected by the pressure transducers or the load cells.

Today, automated shape control systems using computer technology can control shape of the metal strip with the use of shape detectors. Shape detectors or shape feedback devices detect shape defects throughout the metal strip. The shape control system uses the data from the detector for monitoring and continuously correcting the flatness of the metal strip. The automated shape control system relieves the operator from visually checking for defects and manually making changes to the process. Such systems and shape detectors are described in U.S. Pat. Nos. 3,459,019; 3,688,571; 4,289,005; 4,356,714; 4,428,244; 4,512,170; 4,700,557; 4,809,527; 4,809,528; 4,860,212; 4,964,289; 5,089,776; 5,231,858; 5,267,170; 5,285,684; and 5,400,258.

Shape detectors can be a contact or non-contact shape metering device as discussed in the above-mentioned patents. Each type of shape metering device has the main purpose of detecting shape defects in the metal strip and has been used in cold strip mills and in the finishing train of hot strip mills. Some types of shaper Bring devices can also be used to detect metal strip position and, therefore, can also be used for automatic steering control. One problem that arises is that shape detectors must be incorporated into the design of existing mills. Currently for Steckel and other hot strip reversing mills, an operator still checks for shape defects visually and makes manual adjustments to the mill. Visual detection by an operator is still employed because the mills already in operation are generally restricted to the space available to add a contact or non-contact shape metering device. Although overall space is still a concern with new mills, a new mill can be designed to accommodate shape detectors.

Objects of the present invention are to overcome the drawbacks of the prior art designs and to provide a hot strip reversing mill design which incorporates shape detectors in the most efficient and cost-effective manner.

SUMMARY OF THE INVENTION

The objects of the present invention are satisfied by providing a hot strip reversing mill having at least one hot reversing stand, a pair of coilers on either side of the hot reversing stand and at least one shape detector roll adapted to engage the strip worked on by the hot reversing mill. In one embodiment of the present invention, two hot reversing stands are provided which operate in tandem. A shape detector roll may be positioned between the two hot reversing stands. One embodiment of the present invention additionally includes two sets of pinch rolls between the pair of hot reversing stands and respective coiler furnaces. The present invention provides that shape detector rolls may be provided as one of the rolls of each set of the pinch rolls. These and other objects of the present invention will be clarified in the description of the preferred embodiment taken together with the attached figures, wherein like reference numerals represent like elements throughout.

DESCRIPTION OF THE PREFERRED EMBODIMENT

Figure 1:
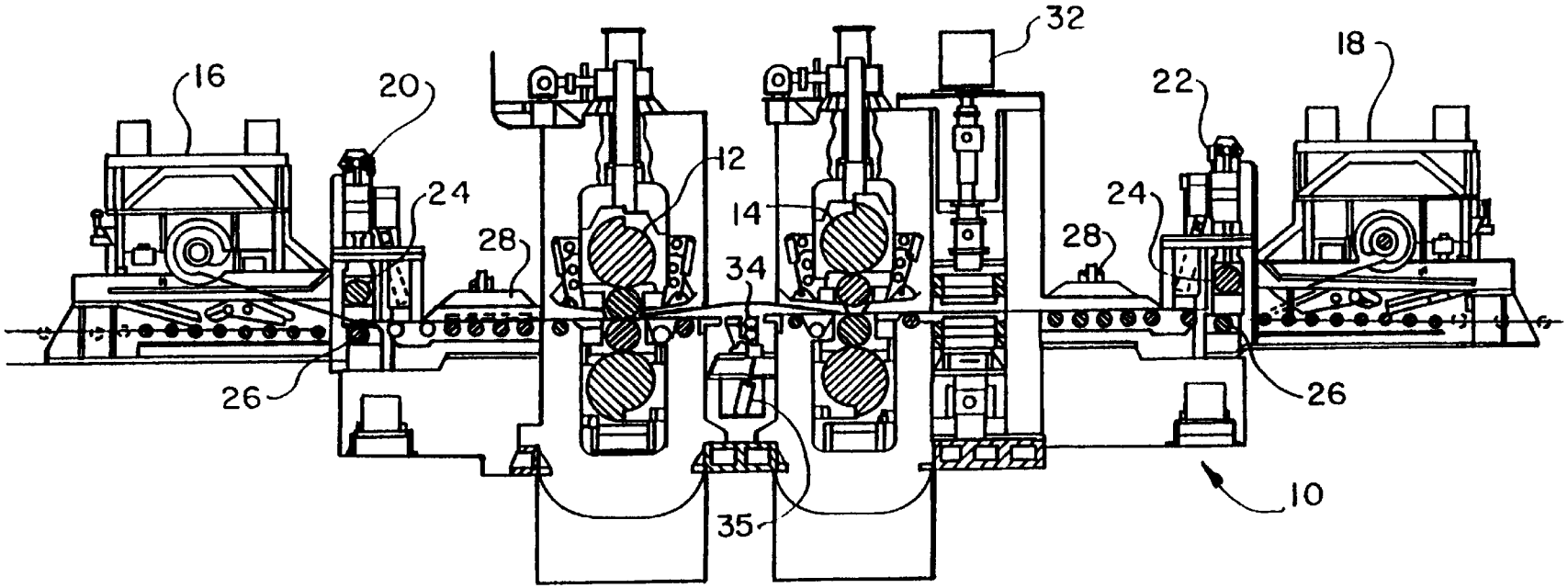
FIG. 1 illustrates a twin stand hot strip reversing mill according to the present invention.

FIG. 1 shows a twin stand hot strip reversing mill 10 according to the present invention. The mill 10 includes a pair of four-high hot reversing mill stands 12 and 14, each having a pair of backup rolls and a pair of work rolls. A coiler furnace 16 is positioned upstream of the mill stand 12 and a coiler furnace 18 is positioned downstream of the mill stand 14. Each coiler furnace 16 and 18 includes a drum about which the product being rolled is coiled once it has been reduced to a thickness capable of being coiled. It is preferred that the mill stands 12 and 14 are designed to operate in tandem. Similar twin stand hot strip reversing mills are described in commonly assigned U.S. Pat. No. 5,511,303; U.S. patent application Ser. No. 08/371,137; and U.S patent application Ser. No. 08/669,999, which are incorporated herein by reference.

The mill 10 includes a pinch roll and shear assembly 20 positioned between the coiler furnace 16 and mill stand 12 and a pinch roll and shear assembly 22 positioned between the mill stand 14 and the coiler furnace 18. The construction of a pinch roll and shear combination is described in commonly assigned U.S. Pat. No. 5,285,670. The pinch rolls of each pinch roll and shear assembly 20 and 22 include a movable top roll 24 and a bottom roll 26. Generally, the top roll 24 is vertically movable relative to the bottom roll 26 between an advanced position where both the top roll 24 and the bottom roll 26 engage the strip and a retracted position where the top roll 24 serves as a deflector roll for the adjacent coiler furnace 16 or 18. The relative movement between the top roll 24 and the bottom roll 26 may be reversed depending upon the position of the adjacent coiler furnace 16 or 18 relative to a pass line of the mill 10. For example, the bottom roll 26 would move vertically relative to the top roll 24 and act as a deflector roll in a retracted position where the adjacent coiler furnace 16 or 18 is below the pass line of the mill 10. In the arrangement shown in FIG. 1, the top roll 24 may be formed as a segmented detector roll to function as a shape metering roll as described in parent application Ser. No. 08/639,724, which is incorporated herein by reference. In the retracted position, the segmented detector roll will be a deflector roll for the strip at the entrance of the adjacent coiler furnace 16 or 18.

The mill 10 additionally includes a pair of centering guides 28 and 30 utilized to help maintain the strip in the appropriate centered position. Centering guide 28 is positioned between the pinch roll and shear assembly 20 and the mill stand 12, and centering guide 30 is positioned between the mill stand 14 and the pinch roll and shear assembly 22. The mill 10 additionally includes a vertical edger 32 positioned between the mill stand 14 and the centering guide 30. The vertical edger 32 is not positioned between the mill stands 12 and 14 in the mill 10 of the present invention to allow for appropriate positioning of a shape detector between the mill stands 12 and 14 as will be described below.

Figure 2:
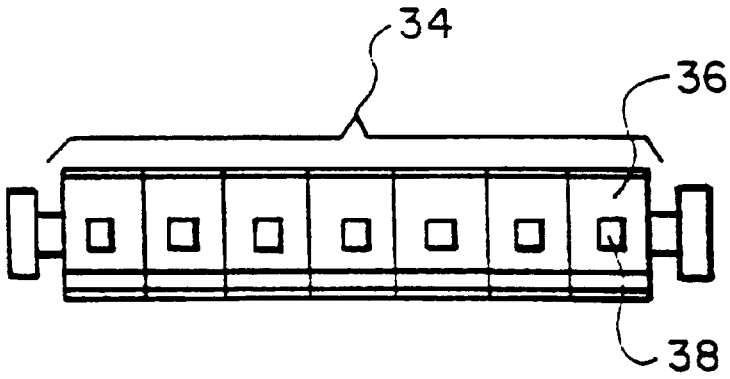
FIG. 2 illustrates a shape detector roll utilized in the hot strip reversing mill according to the present invention.

The present invention provides a shape detector roll 34 positioned between the mill stands 12 and 14. The shape detector roll 34 is movable by hydraulic cylinder 35 to engage the strip being reduced on the mill 10. Through engagement of the strip, the shape detector roll 34 can supply tension to the strip and detect the shape of the worked strip. The shape detector roll 34 is preferably a segmented roll as illustrated in FIG. 2. As shown in FIG. 2, the shape detector roll 34 is formed as a segmented roll made up of a plurality of segments 36 with each segment 36 including a detector 38 such as a load cell or strain gauge to detect strain forces as well as the location of the metal strip in relation to the mill center. The shape detector roll 34 has substantially the same construction as top roll 24 when a shapemetering roll is incorporated into the pinch roll and shear assembly 20 or 22.

Figure 3:
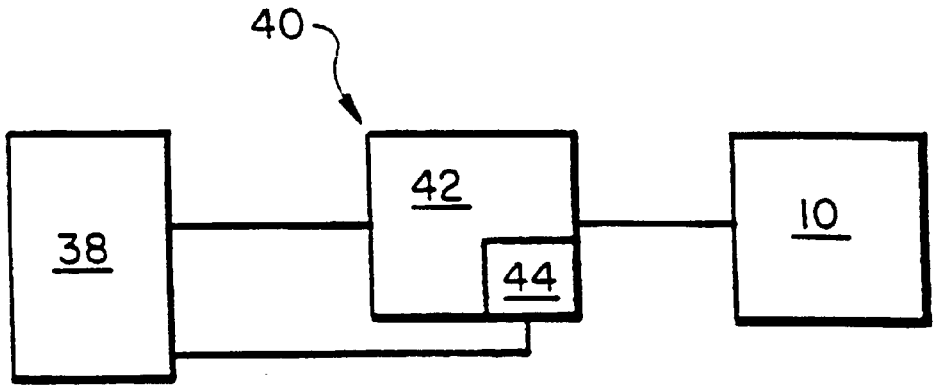
FIG. 3 is a schematic view of an automated shape control system utilized in the hot strip reversing mill according to the present invention.

The operation of an automatic control system 40 is schematically illustrated in FIG. 3. Each detector 38 provides data to a shape control system 42 of the automatic control system 40 which will monitor and continuously correct the profile and flatness of the metal strip. A steering control system 44 can also be included as part of the automatic control system 40 to continuously monitor the tracking of the metal strip along the mill center and correct the steering of the metal strip to ensure that the metal strip drags on mill center. The automatic control system 40 automatically adjusts the mill 10 in a conventional manner. Specifically, the automatic control system 40 may adjust any one or more of roll bending, screw-down positions, roll shifting, steering of the metal strip as well as other control functions of the mill 10 in order to correct defects that occur during the rolling of the metal strip.

As discussed above, in the mill 10 according to the present invention, it is anticipated that in addition to the shape detector roll 34 that the top roll 24 of one or both of the pinch roll and shear assemblies 20 and 22 may be formed as a shape detector roll. Each additional shape detector roll would also be coupled to the automatic control system 40 substantially in the same manner as disclosed in FIG. 3. However, it is anticipated that in certain applications only the shape detector roll 34 between the mill stands 12 and 14 will be necessary, and the top roll 24 of each pinch roll and shear assembly 20 and 22 may be formed as a conventional roll.

The present invention additionally contemplates utilizing individual shape detector rolls between each mill stand 12 and 14 and the associated coiler furnaces 16 and 18 which are not associated with a set of pinch rolls. These shape detector rolls would act as deflector rolls for the adjacent coiler furnace 16 or 18. In the mill configuration shown in FIG. 1, a shape detector roll acting as a deflector roll would be positioned between each respective mill stand 12 or 14 and the associated coiler furnace 16 or 18 essentially where top roll 24 is positioned (in FIG. 1) but would not be associated with a pinch roll and shear assembly 20 or 22. The shape detector roll forming the deflector roll will be on the same side of the pass line as the adjacent coiler furnace 16 or 18. The construction and control for this shape detector roll would be the same as described above for the shape detector roll 34. This modification will be relevant in mill designs where a pinch roll assembly is positioned such that neither of its rolls could serve as a deflector roll for an adjacent coiler furnace.

It will be obvious to those of ordinary skill in the art that various modifications may be made to the present invention without departing from the spirit and scope of the present invention. Consequently, the scope of the present invention is intended to be defined by the attached claims.

What is claimed is:

1. A hot strip reversing mill comprising:

at least one hot reversing stand;

at least one coiler furnace forceiving the strip from said at least one hot reversing stand; and at least one shape detector roll engageable with the strip being reduced on said hot strip reversing mill.

2. The hot strip reversing mill as claimed in claim 1 further including at least two of said hot reversing stands.

3. The hot strip reversing mill as claimed in claim 2 wherein at least one of said shape detector rolls is positioned between said two hot reversing stands.

4. The hot strip reversing mill as claimed in claim 3 including at least two said coiler furnaces, one said coiler furnace positioned on an upstream side of said pair of hot reversing stands and the other of said coiler furnaces positioned on a downstream side of said pair of hot reversing stands and wherein each said shape detector roll is positioned between said coiler furnaces.

5. The hot strip reversing mill as claimed in claim 4 further including a shape control system which receives data from each said shape detector roll in order to correct the defects in the strip using shape control techniques.

6. The hot strip reversing mill as claimed in claim 5 wherein each said shape detector roll comprises a plurality of segments with each segment containing at least one detector.

7. The hot strip reversing mill as claimed in claim 1 wherein at least one of said shape detector rolls is formed as a deflector roll for one said coiler furnace.

8. The hot strip reversing mill as claimed in claim 7 further including two sets of pinch rolls, with each set of pinch rolls being positioned between one said coiler furnace and said at least one hot reversing stand.

9. The hot strip reversing mill as claimed in claim 8 wherein at least one roll of said two sets of pinch rolls is formed as one of said shape detector rolls and one of said deflector rolls.

10. The hot strip reversing mill as claimed in claim 7 wherein each said shape detector roll which is formed as said deflector roll is on the same side of a pass line of said hot strip reversing mill as an adjacent said coiler furnace.

11. The hot strip reversing mill as claimed in claim 1 further including at least two said coiler furnaces, one said coiler furnace positioned on an upstream side of said at least one hot reversing stand and the other of said coiler furnaces positioned on a downstream side of said at least one hot reversing stand.

12. The hot strip reversing mill as claimed in claim 11 further including a pair of said hot reversing stands wherein at least one of said shape detector rolls is positioned between said two hot reversing stands.

13. The hot strip reversing mill as claimed in claim 12 further including two sets of pinch rolls, with each set of pinch rolls being positioned between one said coiler furnace and said pair of hot reversing stands.

14. The hot strip reversing mill as claimed in claim 13 further including a shape control system which receives data from each said shape detector roll in order to correct the defects in the strip using shape control techniques.

15. The hot strip reversing mill as claimed in claim 14 wherein each said shape detector roll comprises a plurality of segments with each segment containing at least one detector.

16. The hot strip reversing mill as claimed in claim 15 wherein at least one roll of said two sets of pinch rolls is formed as a shape detector roll and a deflector roll for an adjacent one said coiler furnace.

17. The hot strip reversing mill as claimed in claim 16 wherein each said shape detector roll of said pinch rolls is on the same side of a pass line of said hot strip reversing mill as an adjacent one of said coiler furnaces.

18. The hot strip reversing mill as claimed in claim 10 further including at least two said coiler furnaces, one said coiler furnace positioned on an upstream side of said at least one hot reversing stand and the other of said coiler furnaces positioned on a downstream side of said at least one hot reversing stand.

19. A method of detecting the shape of a metal coil product while it is being rolled on a twin stand hot reversing mill having coiler furnaces on an upstream and downstream side thereof comprising:

installing a shape detector roll intermediate of the two mill stands;

passing the product back and forth through the two mill stands in at least one of a flat pass mode and a coiling mode;

detecting the shape of the product between the two mill stands on selected passes through the mill stands; and taking corrective action on the mill stands to correct shape in response to a signal from the shape detector roll.

* * * * *

UNITED STATES PATENT AND TRADEMARK OFFICE

CERTIFICATE OF CORRECTION

PATENT NO. : 6,263,716 B1
DATED : July 24, 2001
INVENTOR(S) : Naum M. Kaplan

It is certified that error appears in the above-identified patent and that said Letters Patent is hereby corrected as shown below:

Column 2,
Line 2, "shaper Bring" should read -- shapemetering --.

Column 4, claim 1,
Line 41, "forceiving" should read -- for receiving --.

Signed and Sealed this

Twenty-fifth Day of December, 2001

*Attest:*

*Attesting Officer*

JAMES E. ROGAN
*Director of the United States Patent and Trademark Office*